US006047622A

United States Patent [19]

Tracy et al.

[11] Patent Number: 6,047,622

[45] Date of Patent: Apr. 11, 2000

[54] VENEER SCARFING MACHINE

[75] Inventors: Jason W. Tracy, Albany; John C. Holbert, Corvallis, both of Oreg.

[73] Assignee: Corvallis Tool Co., Philomath, Oreg.

[21] Appl. No.: 09/103,794

[22] Filed: Jun. 24, 1998

[51] Int. Cl.[7] ..... B26D 7/06; B27B 1/00

[52] U.S. Cl. ..... 83/176; 83/418; 83/420; 83/432; 144/3.1; 144/209.1

[58] Field of Search ..... 83/102, 418, 420, 83/432, 472, 176, 425.2, 369, 581, 17, 20; 156/258, 304.5; 144/2.1, 185, 186, 188, 376–377, 209.1, 357, 367, 3.1

[56] References Cited

U.S. PATENT DOCUMENTS

| | | | |
|---|---|---|---|
| 2,314,049 | 3/1943 | Leino | 83/952 X |
| 3,566,937 | 3/1971 | Erickson | 144/327 |
| 4,516,451 | 5/1985 | Takeshita . | |
| 4,813,319 | 3/1989 | Weyand . | |
| 4,905,843 | 3/1990 | Holbert . | |
| 4,931,113 | 6/1990 | Feichtmeir . | |
| 4,934,228 | 6/1990 | Bolton et al. | 83/23 |
| 5,372,168 | 12/1994 | Minami . | |
| 5,711,199 | 1/1998 | Hesketh et al. | 83/23 |

FOREIGN PATENT DOCUMENTS

| | | |
|---|---|---|
| 27 36 401 | 2/1979 | Germany . |

*Primary Examiner*—Rinaldi I. Rada
*Assistant Examiner*—T. Anthony Vaughn
*Attorney, Agent, or Firm*—Robert L. Harrington

[57] ABSTRACT

An apparatus for scarfing edge portions of a veneer sheet to produce a joint suited for joining the veneer sheets in an edge to edge relation. A conveyor system aligns, conveys and flattens the sheet. The sheet as it is being conveyed is engaged by tapered anvils provided on each side of the apparatus that deflect edge portions of the sheet at an angle to the plane of the flattened sheet. A diverter directs the edge of the sheet to one side or the other of the anvils. The resiliency of the sheet maintains the deflected edge portion against the anvil. The edge of the sheet when diverted to one side of the anvils is conveyed through scarfing saws that generate a bevel on each of the deflected side edges. The edge of the sheet when diverted to the opposite side of the anvils by-passes the scarfing saws.

7 Claims, 5 Drawing Sheets

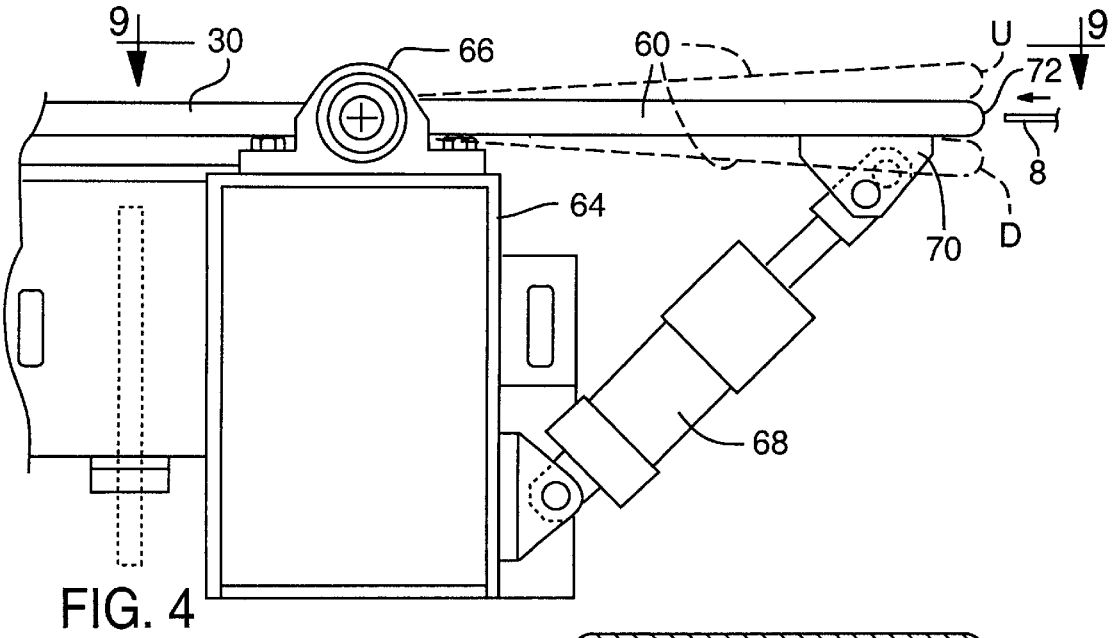
FIG. 4
FIG. 5
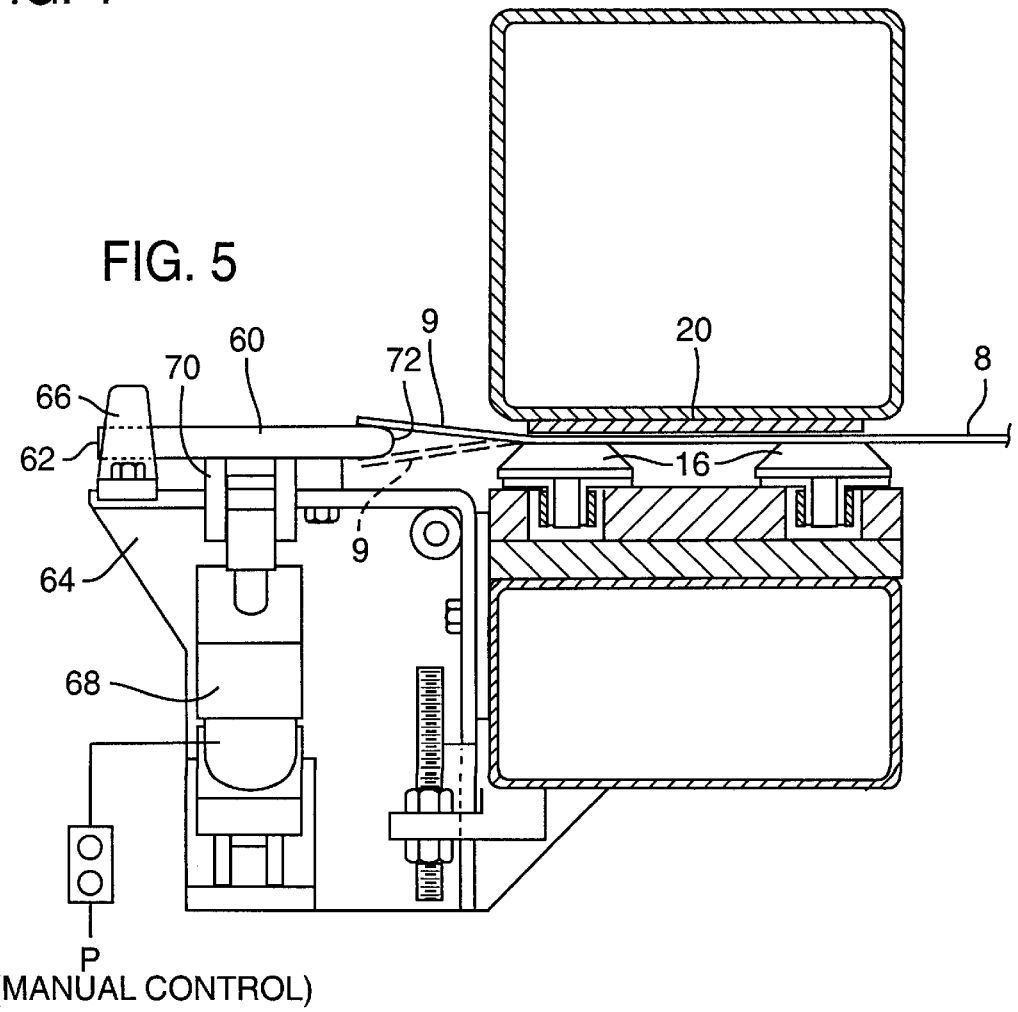

VENEER SCARFING MACHINE

The patent application titled VENEER SCARFING MACHINE, U.S. Ser. No. 08/801,265, filed Feb. 19, 1997 is herein incorporated by reference.

FIELD OF THE INVENTION

This invention relates to a machine for scarfing (beveling) the edges of veneer sheets and more particularly relates to a scarfing machine that has sheet selection capability.

BACKGROUND INFORMATION

Bonding veneer sheets in an end-to-end relation is accomplished by forming tapered edges on the sheets and gluing the tapered edges together. The tapered edges are formed by, e.g., a scarfing machine as illustrated in the above-identified patent application. The scarfing machine has anvils that bend or tilt the edges of the sheet so that a saw that is parallel to the plane of the sheet will produce the desired beveled edge.

While this machine will accurately produce the beveled edges on the veneer sheets, on occasion a sheet will be fed to the machine that the operator (or scanner) determines should not be scarfed and the operator does not have the ability to divert that sheet from being scarfed short of shutting the machine down. An objective of the present invention is to provide the means whereby sheets of veneer being fed into the machine can be selectively passed through the machine without being scarfed or beveled.

BRIEF SUMMARY OF THE INVENTION

The present invention is a scarfing machine that has the selective capability of beveling the edges of a veneer sheet or not beveling the edges of a veneer sheet as the veneer sheets pass through the machine. Anvils are placed along each side edge of the machine and are arranged to deflect or bend the edges of the sheet relative to the plane of the veneer sheet.

A diverter is provided for each of the anvils to direct the edge of the sheet onto one side or the other (top or bottom) of the anvils. When the diverter directs the edge of the veneer sheet onto one side of the anvil, the bent edge of the sheet travels into the scarfing saw which produces the beveled edge. When the diverter directs the edge of the veneer sheet onto the opposite side of the anvil, the bent edge bypasses the scarfing saw.

BRIEF DESCRIPTION OF THE DRAWINGS

FIG. 4 is a side view of an anvil and a diverter assembly of the scarfing machine of FIG. 1;

FIG. 5 is a front view of the diverter assembly of FIG. 4;

DESCRIPTION OF THE PREFERRED EMBODIMENT

Figure 1:
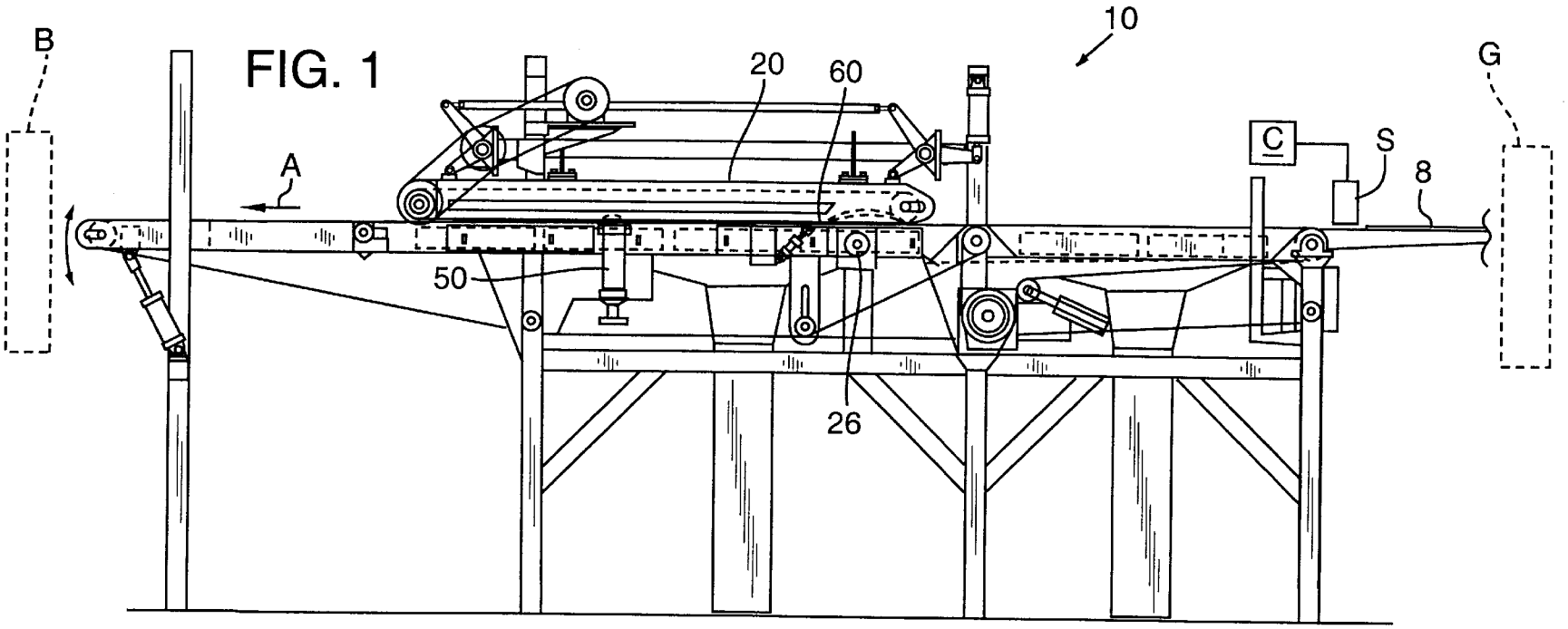
FIG. 1 is a side elevation view of a scarfing machine of the present invention.
Figure 2:
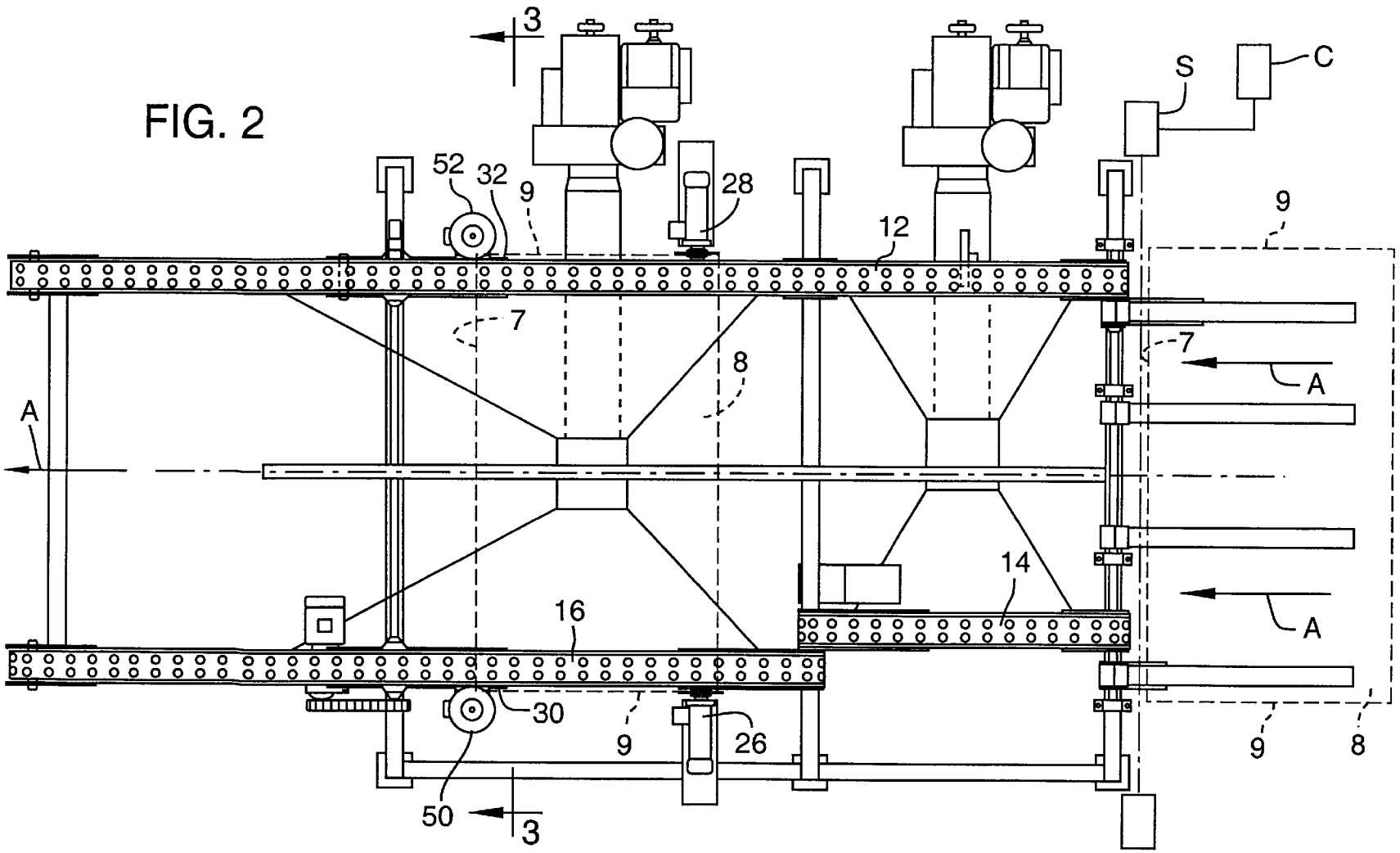
FIG. 2 is a top plan view of the scarfing machine of FIG. 1 but with the upper conveyor removed.

Refer now to FIGS. 1 and 2 of the drawings which illustrate a scarfing machine 10 of the present invention. The machine 10 has bottom conveyors 12, 14 and 16 (FIG. 2). An upper conveyor assembly 20 (FIG. 1) operates cooperatively with the lower belt conveyors to flatten and convey a veneer sheet 8. The veneer sheet 8 is conveyed through the machine 10 in the direction shown by arrow A. The lower belt conveyors 12 and 14 are arranged, if required, to provide skew correction of a veneer sheet 8 as it is being conveyed. A sensor S coupled to a controlling computer C determines whether or not the leading edge 7 of the sheet 8 is square to the travel path A. Conveyor 14 is arranged to be driven either more rapidly than conveyor 12 or more slowly than conveyor 12 to skew the position of the veneer sheet 8 to a squared position when received on the conveyors 12 and 14.

Figure 3:
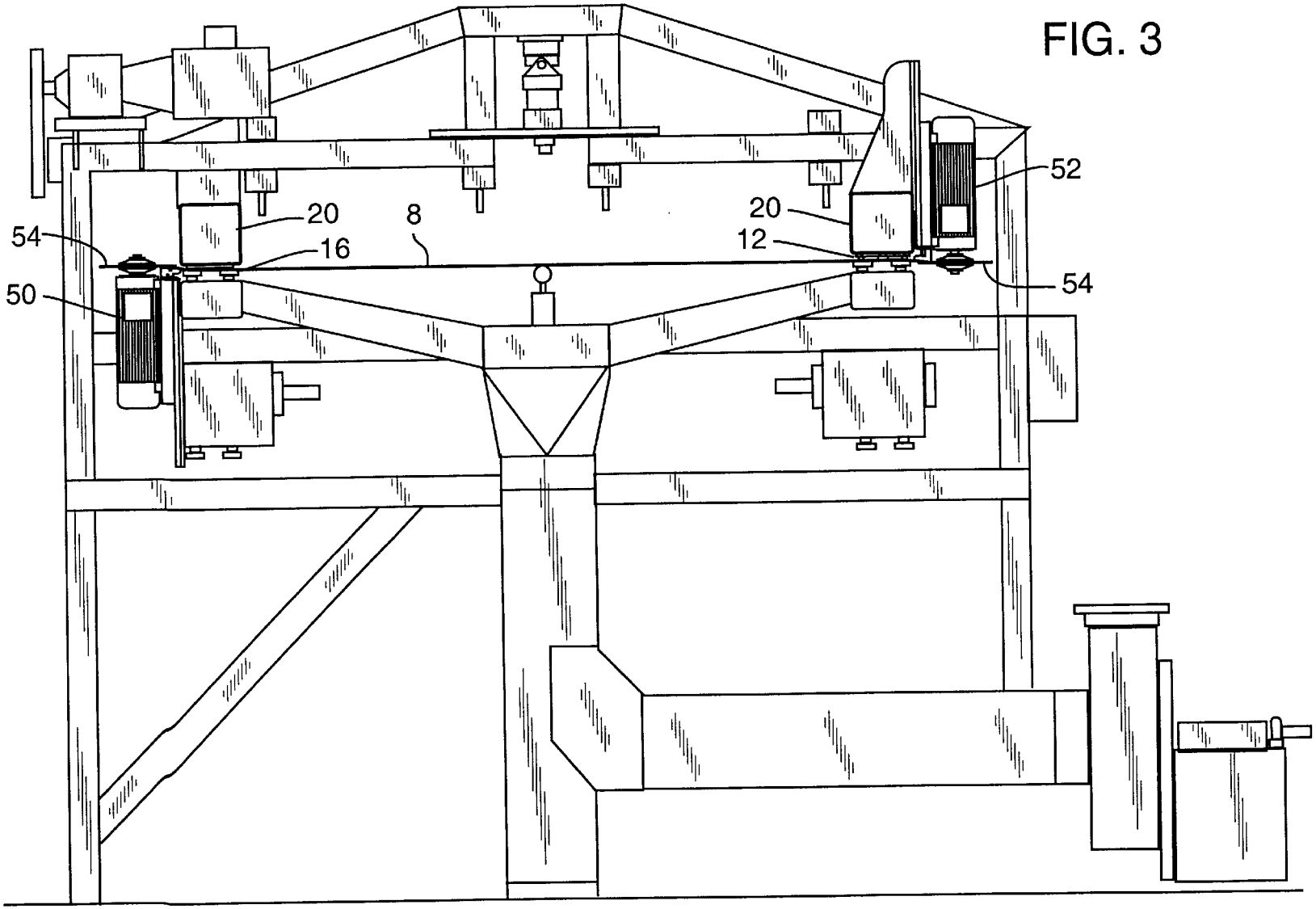
FIG. 3 is a view as viewed on view line 3—3 of FIG. 2.

The side edges 9 of the veneer sheet 8 (dash lines in FIG. 2) are trimmed by trimming saws 26, 28 to dimension each sheet 8. After the edges of the veneer sheet 8 have been trimmed by the trimming saws 26, 28, the edges 9 of the veneer sheet 8 are scarfed by scarfing saws 50, 52 shown in FIG. 2 and in more detail in FIG. 3.

Figure 6:
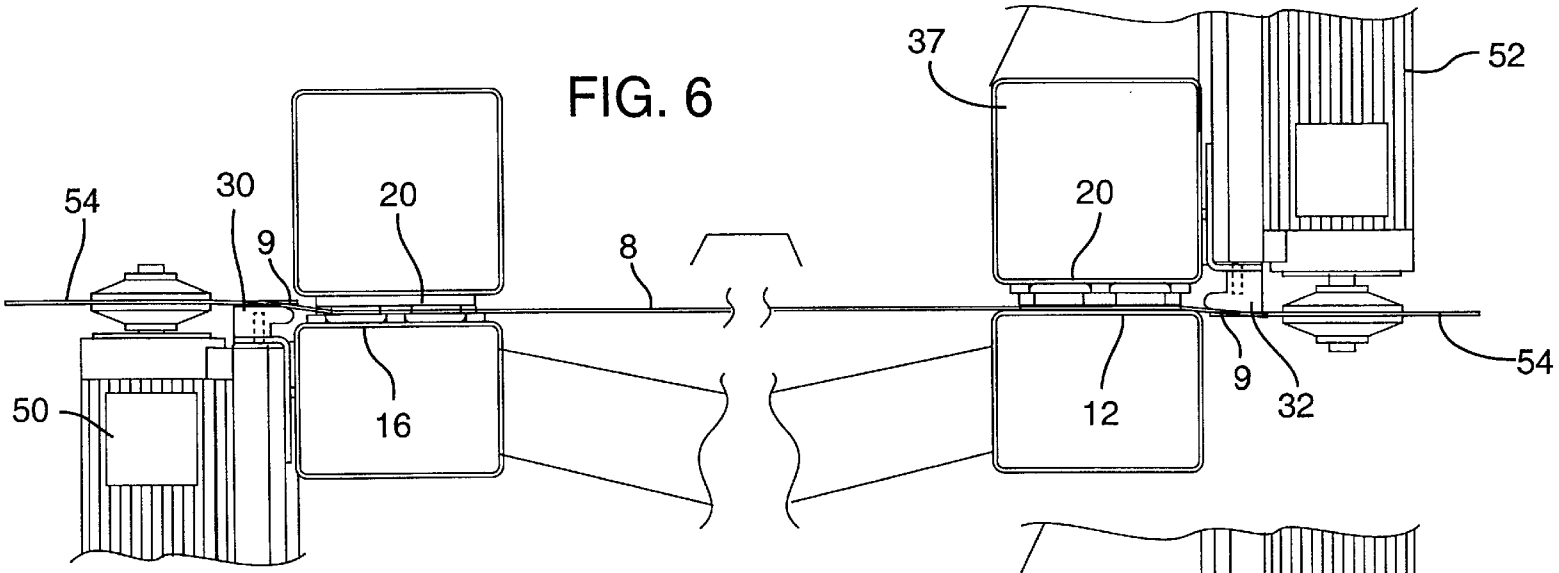
FIGS. 6 and 7 are front views illustrating the cooperative action of the left and right diverter assemblies showing a veneer sheet being scarfed (FIG. 6) and being diverted to avoid scarfing (FIG. 7)
Figure 8:
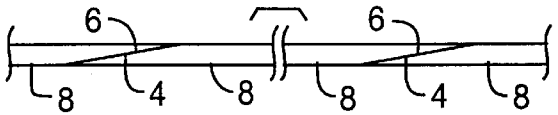
FIG. 8 is a view of joined beveled edges of a plurality of veneer sheets.

FIG. 8 illustrates veneer sheets 8 that have had their edge portions scarfed to form beveled edges 4 and 6. The beveled edge 4 of one sheet 8 is mated with a beveled edge 6 of an adjoining sheet 8 to form a joint. The joint is secured together as by gluing. The process for forming the beveled edges is illustrated in FIG. 6. The edges 9 of the sheets 8 are cammed out of the plane of the sheet 8 by anvils 30, 32. The left side edge 9 as viewed in FIG. 6 is cammed upwardly and the right side edge 9 is cammed downwardly into paths respectively to be scarfed by the blades 54 of saws 50, 52. This process is explained in more detail in the above-referenced patent application.

Figure 7:
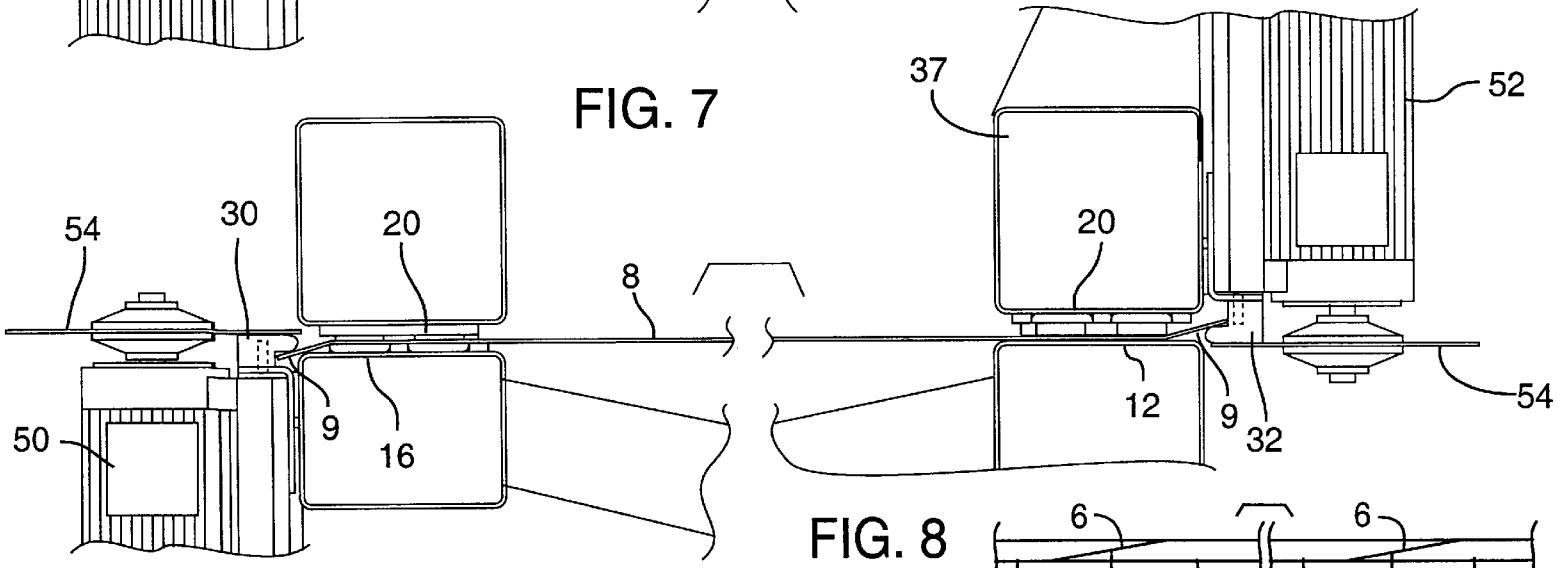

In the present invention, the anvils 30, 32 are provided with diverters (to be explained hereafter) arranged either to direct the side edges of the veneer sheet 8 into the scarfing saws 50, 52, as explained above and illustrated in FIG. 6, or to direct the side edge of the sheet 8 away from the scarfing saws 50, 52 as illustrated in FIG. 7. When the edges of the sheet 8 are directed to the opposite side of the anvils 30, 32, as illustrated in FIG. 7, the edge portion 9 of the sheet 8 will simply bypass the scarfing saws 50, 52 and will not have a beveled edge generated on the edges.

Figure 9:
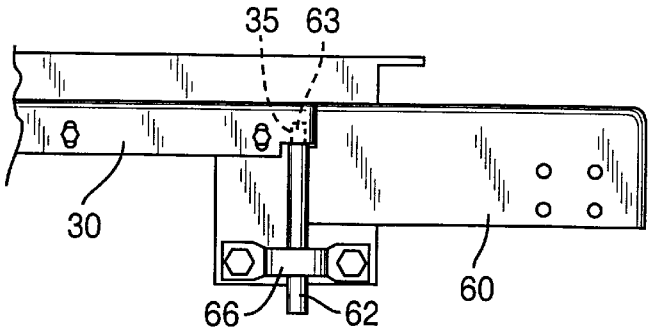
FIG. 9 is a view of the anvil and diverter as viewed on view lines 9—9 of FIG. 4.

A diverter assembly 60, best seen in FIG. 4, (side view) and it FIG. 5 (front view) is positioned in front of anvil 30 to selectively divert the edge of the sheet 8 to one side or the other (top or bottom) of the anvil 30. A similar mirror image diverter (not shown) is provided for anvil 32. A shaft 62 of the diverter 60 is pivotally mounted to the frame 64 on a bearing 66 of the machine 10. An end 63 of the shaft 62 is rotatably supported in a bore 35 of the anvil 30 (see FIG. 9). A cylinder 68 extending from the frame 64 is connected to a bottom bracket 70 near the extended or leading end of the diverter 60. The cylinder pivots the diverter upwardly and downwardly as illustrated in FIG. 4 by dash lines.

The diverter 60 has a formed side edge 72 (FIG. 5) that has the same shape as the side edge of anvil 30 (see FIGS. 6 and 7). The diverter 60 in effect becomes an extension of the anvil 30. As shown in FIG. 4, the leading end of the diverter 60 (at the right side of FIG. 4) is pivotable above and below the plane of the anvil 30. The diverter 60 is shown in FIG. 4 in the up position in dashed line designated by U and in the down position by dashed line designated by D. The diverter 60 is shown in solid line as extended in the same plane as the anvil 30 for illustration purposes only as in operation the diverter would reside in either the up or down positions.

When the leading end of the diverter is pivoted to its upper position U, the leading end of edge 9 of the veneer sheet 8 will engage the bottom surface of the diverter 60 and be directed to pass below the anvil 30 and thus the side edge 9 of the sheet 8 will be bent downward as seen in dash lines in FIG. 5. When the leading end of the diverter 60 is pivoted to its down position D, the leading end of side edge 9 of the sheet 8 will engage the top surface of diverter 60 and be directed to pass above the anvil 30. The edge 9 of the veneer sheet will then be bent upward as seen in solid lines in FIG. 5.

As mentioned, each side of the machine is provided with a diverter which is preferably operable independently of each other. In this embodiment, when the diverter 60 is pivoted downward to direct the edge 9 of the veneer sheet 8 above the anvil 30, the edge of the veneer sheet will be bent upwardly and will travel into the saw 50, with the blade 54 of the saw 50 scarfing (beveling) the edge 9 of the sheet 8 as shown in FIG. 6. When the diverter 60 is pivoted upward to direct the edge of the sheet 8 below the anvil 30, the edge of the sheet 8 will be bent downward and will be out to of the path of the blade 54 of the saw 50 as shown in FIG. 7 and therefore the edge of the sheet 8 will not be scarfed. The anvil 32 and saw 52 are arranged in the opposite manner. When the diverter for anvil 32 is pivoted downward to direct the edge of the sheet 8 above the anvil 32, the edge of the sheet 8 will be bent upward and out of the path of the blade 54 of the saw 52 as shown in FIG. 7. When the diverter for anvil 32 is pivoted upward to direct the edge of the sheet 8 downward below the anvil 32, the edge of the sheet 8 will be bent downward and will travel into the blade 54 of the saw 52 as shown in FIG. 6, thus resulting in the edge of the sheet 8 being beveled.

Typically the veneer sheets 8 are graded at a grading station G (see FIG. 1) before feeding the sheets 8 through the machine 10. The grade of the sheet 8 may be used to determine if both edges 9 are to be scarfed (beveled), one edge is to be scarfed or if the sheet 8 is to pass through the machine without either edge being scarfed. Multiple sorting bins B are provided at the exit end of the machine 10 to sort the sheets 8 selectively according to the operations performed on the sheet 8.

The independent operation of each diverter provides the capability of scarfing both edges 9 of the sheet 8, scarfing one edge 9 only or not scarfing either edge of the sheet 8. The operation of the cylinders 68 to activate the diverters to the up or down positions may be done by, e.g., scanners and computers in an automatic operation or by an operator using a control panel P schematically illustrated in FIG. 5.

There is a benefit to bending the edge 9 of the sheet relative to the plane of the flattened sheet 8 rather than inclining the scarfing saw relative to the plane of the sheet. Bending the edge against the anvil flattens the waves on the edge of the sheet and the tension in the fibers holds the sheet firm and flat on the anvil while scarfing. This results in a superior and more uniform scarf cut which provides a uniform and precise joint when the beveled edges are joined.

Those skilled in the art will recognize that modifications and variations may be made without departing from the true spirit and scope of the invention. The invention is therefore not to be limited to the embodiments described and illustrated but is to be determined from the appended claims.

What is claimed is:

1. A veneer scarfing machine comprising:

a conveyor system defining a path of conveyance for conveying and flattening a veneer sheet having opposed and parallel side edges;

a scarfing saw at one side of the conveyor system for scarfing a side edge of the veneer sheet;

an anvil mounted on said side of the machine at a position immediately preceding the scarfing saw in said path of conveyance for bending a side edge of the veneer sheet toward the saw as it is being conveyed past the saw for scarfing the edge of the veneer sheet;

and a diverter preceding the anvil in said path of conveyance and selectively actuated to divert the side edge of the veneer sheet away from the saw to avoid scarfing.

2. A veneer scarfing machine as defined in claim 1 wherein:

the anvil has upper and lower sides and the diverter is pivoted in one direction to divert the side edge of the sheet to one side of the anvil for scarfing the side edge and pivoted in the opposite direction to divert the edge of the sheet to the opposite side of the anvil for avoiding scarfing.

3. A veneer scarfing machine as defined in claim 2 wherein:

an anvil is provided at both side edges and a diverter is provided for each of the anvils.

4. A scarfing machine as defined in claim 1 wherein:

the anvil has a curved side edge portion positioned in the path of the side edge of the veneer sheet being conveyed and provides similar bending of the side edge passing over or under the curved side edge portion, and the diverter has a ramp portion having upper and lower ramp surfaces and a rear end adjacent a leading end of the anvil and providing a horizontal pivot around which a leading end of the diverter is pivoted between an up position for receiving and diverting the edge of the veneer along the lower ramp surface to the bottom side of the anvil and a down position for receiving and diverting the edge of the veneer along the upper ramp surface to the top side of the anvil.

5. A scarfing machine as defined in claim 4 wherein an actuator selectively actuates the pivoting of the diverter.

6. A scarfing machine as defined in claim 4 wherein a control panel activates the actuator and is controlled by an operator.

7. A scarfing machine as defined in claim 3 wherein each diverter is operable independent of the other.

* * * * *